US007278214B2

(12) United States Patent
Ralston

(10) Patent No.: US 7,278,214 B2
(45) Date of Patent: Oct. 9, 2007

(54) ELECTRIC PENCIL SHARPENER

(75) Inventor: Marie Ralston, Fountain Hills, AZ (US)

(73) Assignee: Z-Pointe Incorporated, Fountain Hills, AZ (US)

( * ) Notice: Subject to any disclaimer, the term of this patent is extended or adjusted under 35 U.S.C. 154(b) by 370 days.

(21) Appl. No.: 10/859,658

(22) Filed: Jun. 3, 2004

(65) Prior Publication Data

US 2005/0268471 A1 Dec. 8, 2005

(51) Int. Cl.
*B43L 23/00* (2006.01)

(52) U.S. Cl. ..... 30/454; 30/458

(58) Field of Classification Search ..... 30/451, 30/452–462

See application file for complete search history.

(56) References Cited

U.S. PATENT DOCUMENTS

| | | | | |
|---|---|---|---|---|
| 432,789 | A | 7/1890 | Burger | |
| D75,087 | S | 5/1928 | Whiteside | |
| 3,004,522 | A | 10/1961 | Kent | |
| 3,275,819 | A | 9/1966 | Laurent | |
| 3,289,641 | A * | 12/1966 | Ginsberg | 144/28.5 |
| 3,467,843 | A | 9/1969 | Dailey | |
| 3,650,308 | A | 3/1972 | Hori | |
| 3,678,975 | A | 7/1972 | Imanishi et al. | |
| 3,851,687 | A | 12/1974 | Jones | |
| 3,889,730 | A * | 6/1975 | Buc | 144/28.5 |
| 4,025,319 | A | 5/1977 | Smith | |
| D244,604 | S | 6/1977 | Ohta | |
| 4,050,487 | A * | 9/1977 | Mabuchi et al. | 144/28.5 |
| 4,066,109 | A * | 1/1978 | Narang et al. | 144/28.11 |
| D249,152 | S | 8/1978 | Macowski | |
| 4,206,842 | A | 6/1980 | Burridge, Jr. | |
| 4,513,798 | A | 4/1985 | Luttgens | |
| 4,944,402 | A | 7/1990 | Wu | |
| 5,043,855 | A | 8/1991 | Yelvington | |
| 5,167,071 | A | 12/1992 | Eisen | |
| 5,379,817 | A * | 1/1995 | O'Neil et al. | 144/363 |
| 5,394,613 | A | 3/1995 | Ku | |
| 6,065,514 | A * | 5/2000 | New | 144/28.5 |
| 6,845,795 | B2 * | 1/2005 | Lammers et al. | 144/28.5 |
| 6,944,960 | B2 * | 9/2005 | Co | 30/454 |

* cited by examiner

*Primary Examiner*—Kenneth E. Peterson
*Assistant Examiner*—Sean Michalski
(74) *Attorney, Agent, or Firm*—Vedder Price Kaufman & Kammholz

(57) ABSTRACT

An electric pencil sharpener includes a power source, such as a plurality of batteries, disposed within a base portion. The electrical pencil sharpener further includes a housing portion connected to the base portion and a motor disposed within the housing portion, operatively coupled to the power source. The pencil sharpener includes a head portion with a plurality of mounting elements for operatively connecting the head portion to the housing portion. Furthermore, each head portion includes a blade assembly disposed therein, wherein the blade assembly is operatively connected to the motor and the selective activation of the motor rotates the blade assembly relative to the head portion, therein sharpening a pencil. Moreover, the head portion with the plurality of mounting elements is removable from the housing portion for the disposal of pencil shavings or the insertion of other head portions for the sharpening of pencils having different dimensions.

8 Claims, 9 Drawing Sheets

ELECTRIC PENCIL SHARPENER

FIELD OF THE INVENTION

The present invention relates generally to a pencil sharpener, and more specifically to an electric pencil sharpener having a plurality of interchangeable head portions.

BACKGROUND OF THE INVENTION

A pencil, such as a conventional No. 2 pencil, a cosmetic pencil, or any other type of marking instrument is typically recognized by those of skill in the art as having an outer layer of material commonly constructed from wax, wood, or any other suitable material. An inner core is surrounded by the outer layer and is commonly constructed from graphite, cosmetic lead, or any other suitable marking material. A common problem with pencil sharpening is the removal of the outer layer material with regard to the softer inner core material and the creation of an acceptable tip on the inner core material relative to the outer layer for proper use of the pencil.

One conventional pencil sharpener is a simple plastic device having a receptacle and a metal blade disposed such that a pencil disposed within the receptacle contacts the blade. This pencil sharpener, while very small and portable, has a single blade for sharpening pencils having various different diameters. Another problem is that the shavings from the outer layer must be collected or the pencil must be sharpened over a trash receptacle.

A common solution which overcomes the problem associated with pencil shavings includes a catching retainer, such as a plastic casing, operatively connected to the sharpener in communication with a track from which the shavings emerge, as the pencil is being sharpened. The disadvantage of a single common blade for all pencil diameters remains.

Another conventional pencil sharpener uses an electrical source, such as a battery, for powering an electrical motor which rotates the sharpening blade relative to the pencil. For example, U.S. Pat. No. 6,065,514 describes a compact, hand-held battery-operated cosmetic pencil sharpener. This pencil sharpener includes a blade assembly having two elements each disposed at different angles for sharpening the outer casing of the pencil and the inner wax-like core of a cosmetic pencil. U.S. Pat. No. 6,065,514 also discloses a completely inclusive electrical system, where an electrical source, such as a battery, powers a motor for rotating of the dual element blade. Although U.S. Pat. No. 6,065,514 overcomes disadvantages related to the different materials and orientation of the inner core material and the outer casing material with respect to the process of sharpening a pencil, this prior art reference fails to overcome disadvantages related to pencils with various different diameters.

Therefore, there exists a need in the art for an improved pencil sharpener having, among other benefits, interchangeable heads for providing improved sharpening for pencils of various different diameters.

SUMMARY OF THE INVENTION

Generally, a pencil sharpener in accordance with one aspect of the present invention, includes a base portion having a power source contained therein and a housing portion connected to the base portion. A motor is disposed within the housing portion and operatively coupled to the power source.

The pencil sharpener further includes a head portion having a plurality of mounting elements disposed on a lower rim of the head portion, wherein the mounting elements enable connecting the head portion to the housing portion. Further, a blade assembly is disposed within the head portion, wherein the blade assembly is connected to the motor and when the motor is turned on, the blade assembly rotates relative to the head portion in order to sharpen a pencil disposed within the head portion.

The head portion further includes a cavity to collect pencil shavings generated by the blade assembly during the sharpening process where the head portion is coupled to the housing portion, the pencil shavings are trapped within the cavity portion providing for the collection of the pencil shavings. Further, the head portion is removable from the housing portion by disengaging the mounting elements which are in contact with the housing portion. When the head portion is removed, the pencil shavings disposed within the cavity portion may be deposited directly into a waste receptacle. Moreover, one of a plurality of different head portions may be interchangeably disposed on the housing portion. The head portions have receptacles of different configurations in order to sharpen pencils having different diameters. As such, the present invention includes an electric pencil sharpener having interchangeable head portions which may be readily connected to and disengaged from the housing portion for sharpening pencils having different diameters and the electric pencil sharpener further includes a cavity portion which collects shavings and enables easy disposal of pencil shavings.

DETAILED DESCRIPTION OF THE INVENTION

Figure 1:
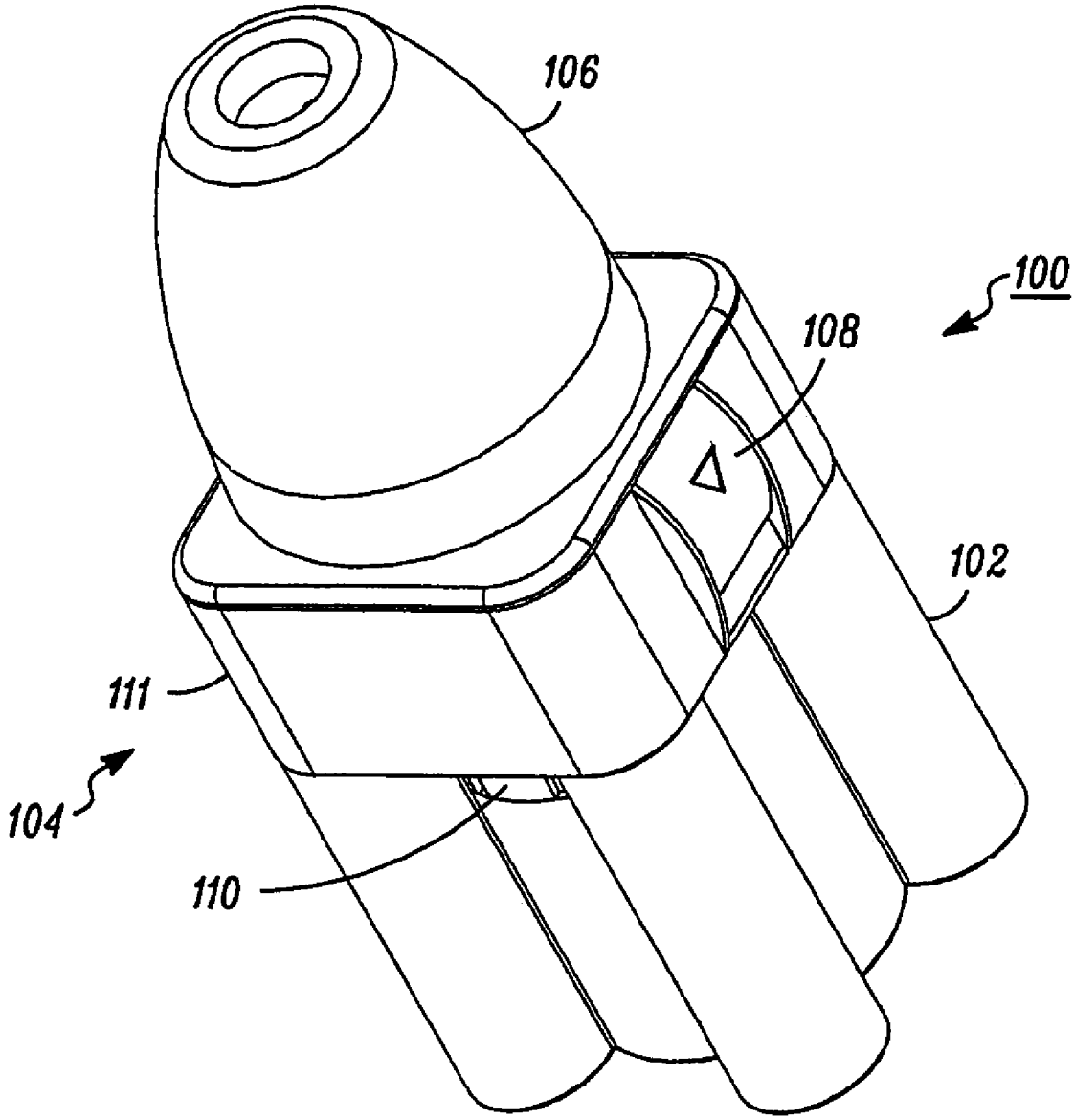
FIG. 1 is a perspective view of an electric pencil sharpener, in accordance with one embodiment of the present invention.

FIG. 1 illustrates a pencil sharpener 100 having a base portion 102, a housing portion 104, and a head portion 106. The head portion 106 is connected to the housing portion 104 by mounting elements (not shown in this FIG. 1) disposed on an underside of the head portion which engage receiving portions (not shown in this FIG. 1) on the housing portion 104. Further illustrated within FIG. 1, the pencil sharpener 100 includes a power switch 108 medially disposed on the housing portion 104.

The base portion 102 is connected to the housing portion 104 by at least one connecting tab 110 disposed on the base portion 102. The connecting tab 110 engages a receiving member (not shown in this FIG. 1) on an underside of a medial portion 111 of the housing portion 104.

Figure 2:
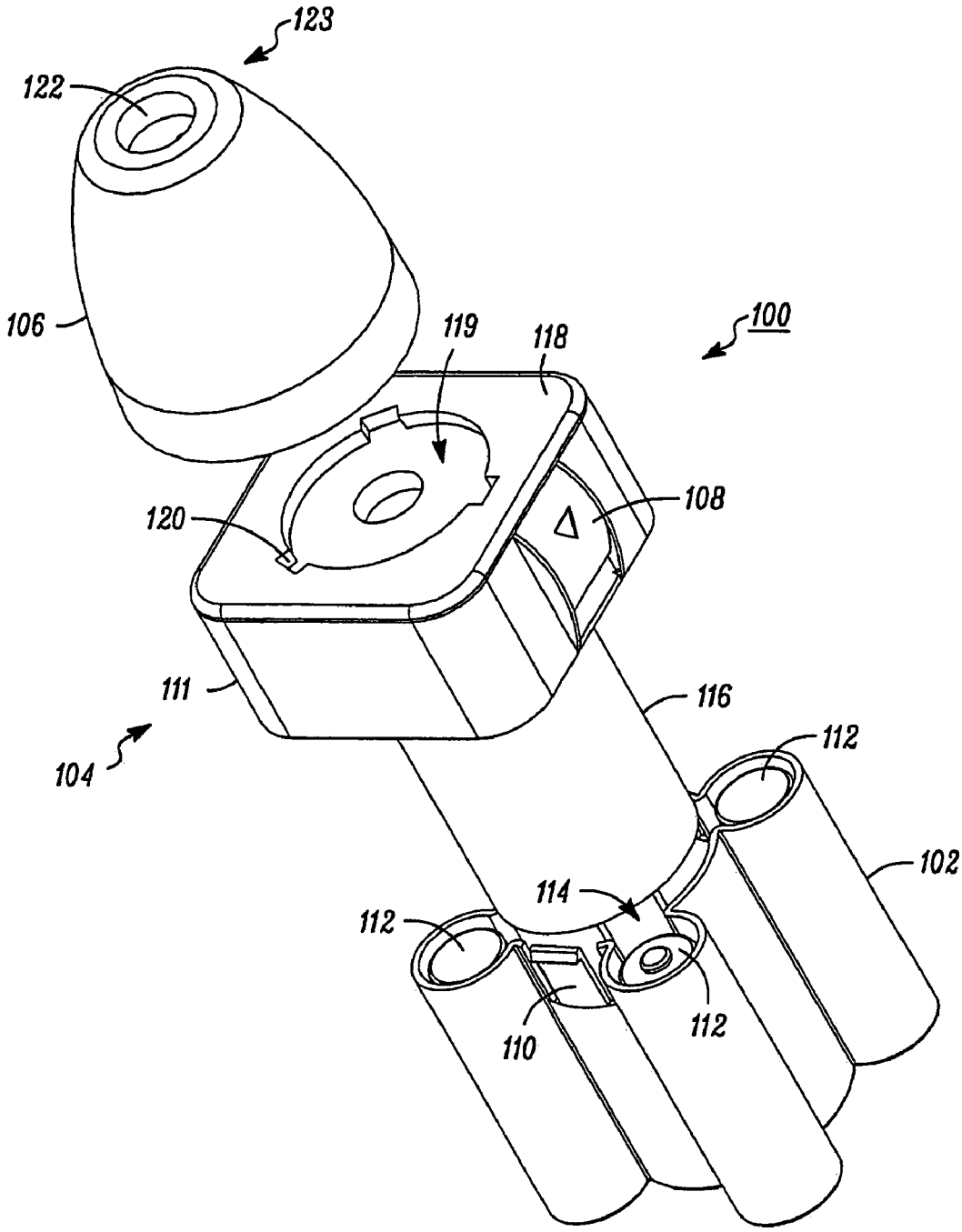
FIG. 2 is an exploded view of the electrical pencil sharpener of FIG. 1.
Figure 6:
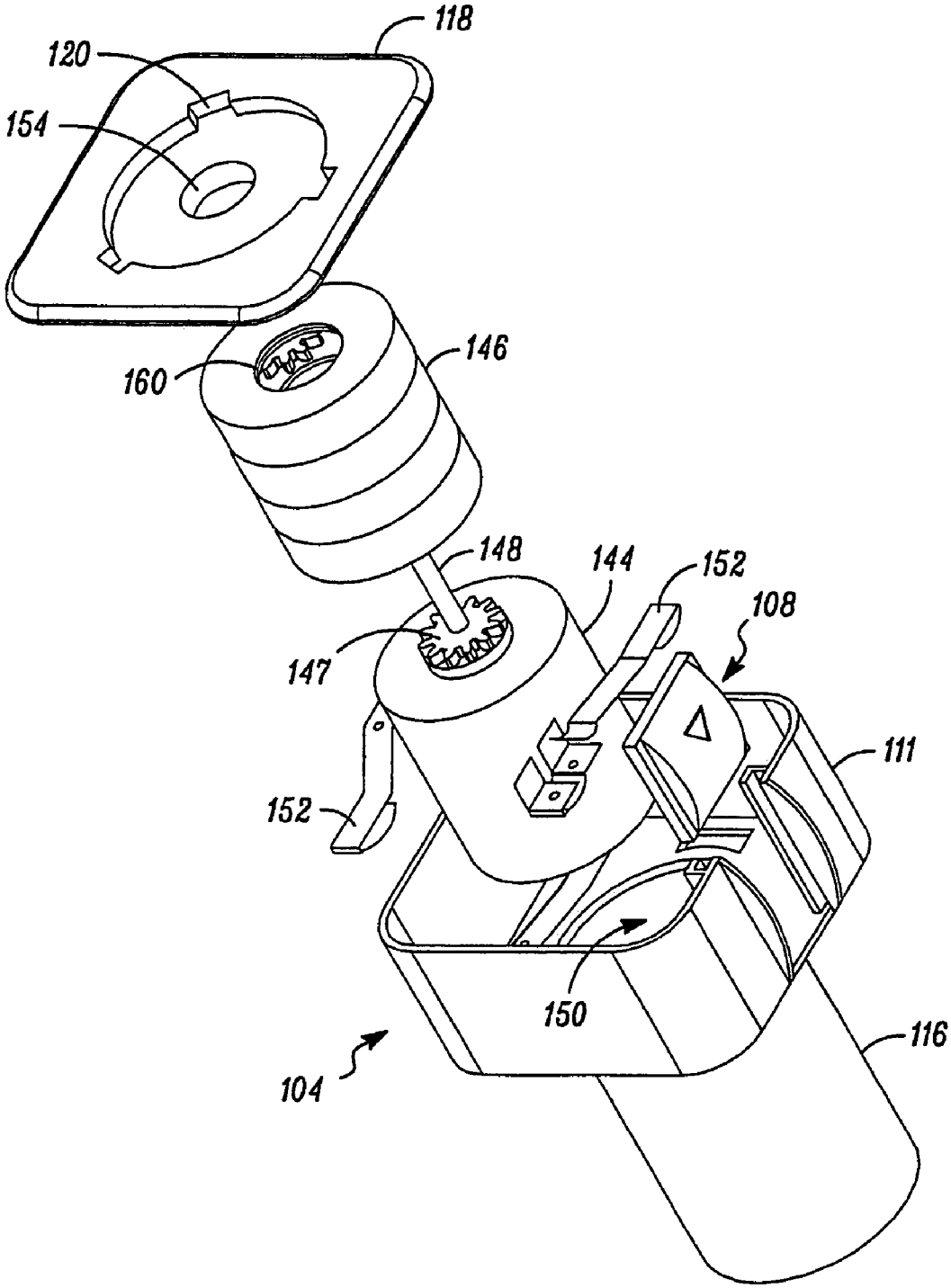
FIG. 6 is an exploded view of a housing portion, in accordance with one embodiment of the present invention.

FIG. 2 illustrates an exploded view of the pencil sharpener 100 of FIG. 1. A plurality of power sources 112 are disposed within the base portion 102. Also formed on the base portion 102 is a connecting tab 110. The base portion 102 includes a hollow receptacle 114 for receiving a bottom portion 116 of the housing portion 104. The housing portion 104 contains a motor (not shown in this FIG. 2). When a user activates the power switch 108 on the medial portion 111 of the base portion 104, the motor (shown in this FIG.6 is activated by the multiple power sources 112.

In one embodiment, disposed on a bottom side of the medial portion 111 of the housing portion 104 are a plurality of electrical contacts (not shown in this FIG. 2) which electrically couple the power sources 112 to the motor (not shown in this FIG. 2) disposed within the housing portion.

FIG. 2 further illustrates a top plate 118 of the housing portion 104 which includes a recessed cavity 119 for receiving a projection (not shown in this FIG. 2) of the head portion 106. As discussed below with reference to FIG. 3, the multiple mounting elements (not shown in this FIG. 2) engage receiving slots 120 disposed on the plate 118.

The head portion 106 includes an insertion receptacle 122 having an opening disposed on the top 123 of the head portion 106. The insertion receptacle 122 receives marking instrument for sharpening, such as a pencil, within the head portion 106. A blade assembly (not shown in this FIG. 2) is disposed within the hand portion 106 for rotation by the motor (not shown in this FIG. 2) disposed within the housing portion 104 for sharpening a pencil disposed within the insertion receptacle 122.

Figure 3:
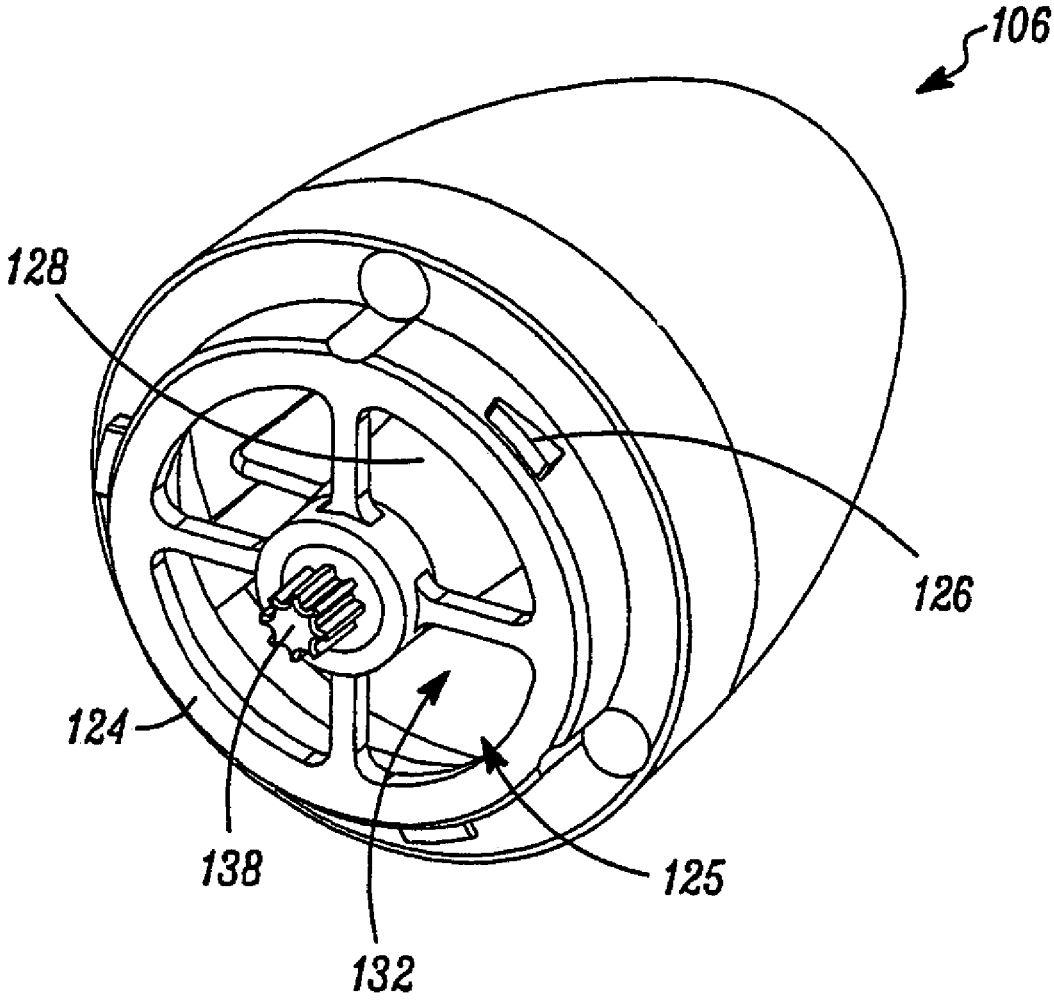
FIG. 3 is a perspective view of a head portion, in accordance with one embodiment of the present invention.

FIG. 3 illustrates the head portion 106 which includes a mounting flange 124 that contacts the mounting plate 118 of the housing portion (104 as shown in FIG. 2). The head portion 106 also includes mounting elements 126 disposed on the lower portion of the head portion 106. The mounting elements 126 engage the slots (shown at 120 in FIG. 2) to connect the head portion 106 to the housing portion 104.

The blade assembly 128 is disposed within the head portion 106, as discussed in greater detail with reference to FIGS. 4 and 5. The blade assembly 128 includes an engagement gear 138 which, upon connection of the head portion 106 to the housing portion, engages the motor disposed within the housing portion. Also illustrated FIG. 3, the head portion 106 includes a cavity portion 132 which collects shavings from the sharpened marking instrument, such as a pencil. The cavity portion 132 collects the shavings which may be easily and cleanly disposed of after removing the head portion 106 from the housing portion and pouring the pencil shavings through the openings 125 of the connecting flange 124.

Figure 4:
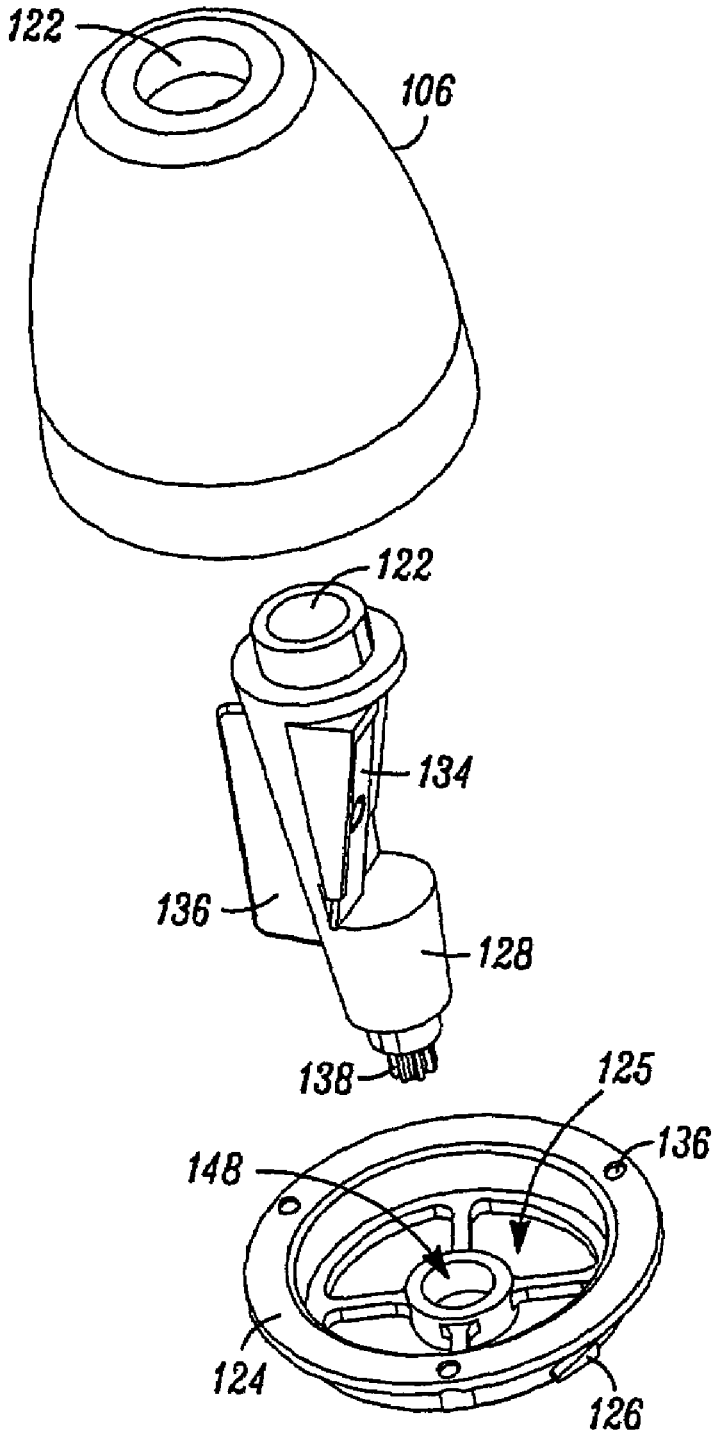
FIG. 4 is an exploded view of one embodiment of the head portion of FIG. 3.

FIG. 4 illustrates an exploded view of the head portion 106, showing the blade assembly 128 and the mounting flange 124. The head portion 106 includes the insertion receptacle 122 which is further defined within the blade assembly 128. When assembled, the blade assembly 128 engages a top-most portion of the head portion 106, such that the insertion receptacle 122 is defined through the outer casing of the head portion 106 and within the blade assembly 128. The blade assembly 128 further includes sharpening blade 134 and a shaving clearing flange 136.

In one embodiment, the mounting flange 124 is connected to the head portion 106 by a plurality of fastening devices, such as, but not limited to, a rivet, a screw, an adhesive or any other suitable affixing device as recognized by one of skill in the art. When the flange 124 is connected to the head portion 106, the blade assembly 128 is secured within the head portion 106. Moreover, the engagement gear 138 extends through an opening 148 in the mounting flange 124. The mounting flange 124 has mounting elements 126 disposed thereon for engaging the slots formed in the housing portion.

Figure 5:
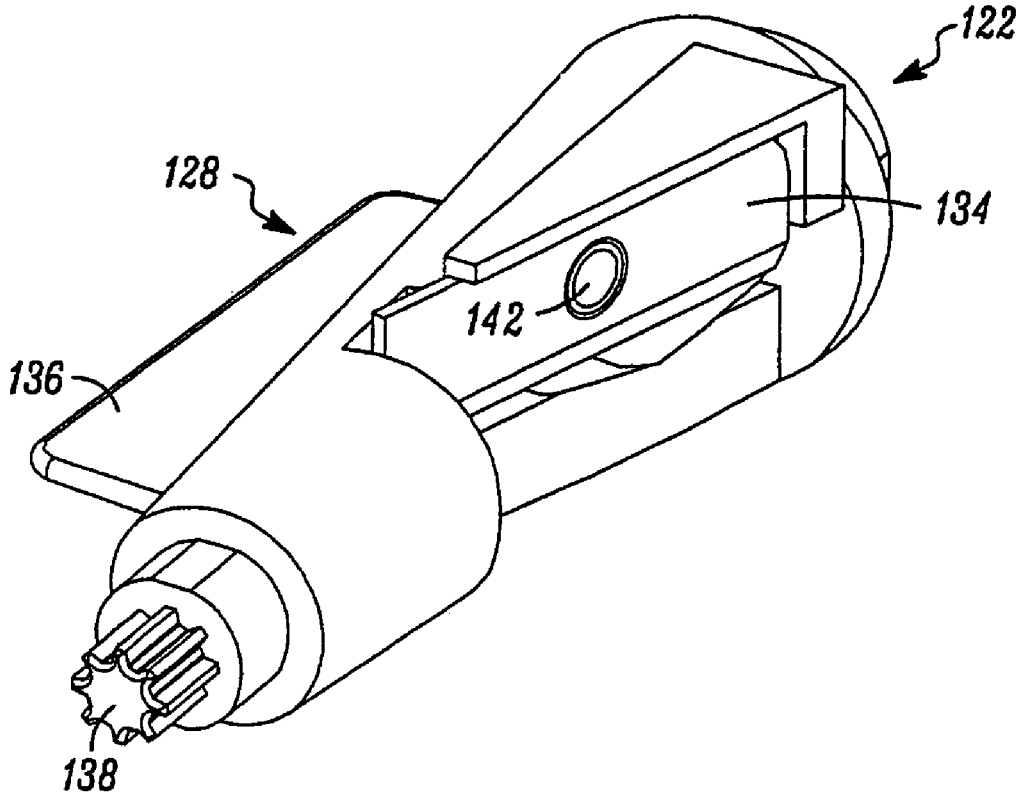
FIG. 5 is a perspective view of a sharpening assembly disposed within the head portion, in accordance with one embodiment of the present invention.

FIG. 5 illustrates a perspective view of the blade assembly 128 having the blade 134, a shaving clearing flange 136 and the engagement gear 138. In one embodiment, the blade 134 is attached to the blade assembly 128 by an engagement pin 142. The blade assembly 128 includes the insertion receptacle 122 defined therein such that a pencil or other marking instrument may be disposed therein so that a tip of the pencil engages the blade 134. The engagement gear 138 engages the motor in order to rotate the blade assembly 128 so that the shaving flange 136 stabilizes the blade assembly 128 within the housing portion 106 and displaces the shavings such that the head assembly does not get clogged.

FIG. 6 illustrates an exploded view of the housing portion 104, including the bottom portion 116. The motor 144 is disposed within an inner cavity 150 and is coupled to a planetary gear assembly 146 via a gear 147 and the gear shaft 148. In one embodiment, the planetary gear assembly 146 is disposed within the medial portion 111 of the housing portion 104.

FIG. 6 further illustrates the power switch 108 disposed on the medial portion 111 of the housing portion 104. The power switch 108 activates a plurality of electrical contacts 152 which are electrically coupled to the power source. When the power switch 108 is activated to an ON position the electrical contacts 152 are closed to complete the circuit, and when the power switch 108 is activated to an OFF position the electrical contacts 152 are open and the circuit is discontinuous. Furthermore, the housing portion 104 includes the top plate 118, which has a substantially circular recessed portion 119, which includes the plurality of receiving slots 120 formed on the periphery thereof for engaging the head portion 106. The top plate 118 further includes a center bore 154 which the engagement gear (138, in FIG. 5) extends through in order to engage the planetary gear assembly 146. In one embodiment, the top plate 118 is snap-fitted to the housing portion by cooperative engagement of the elements disposed on the medial portion 111 of the housing portion 104.

Figure 7:
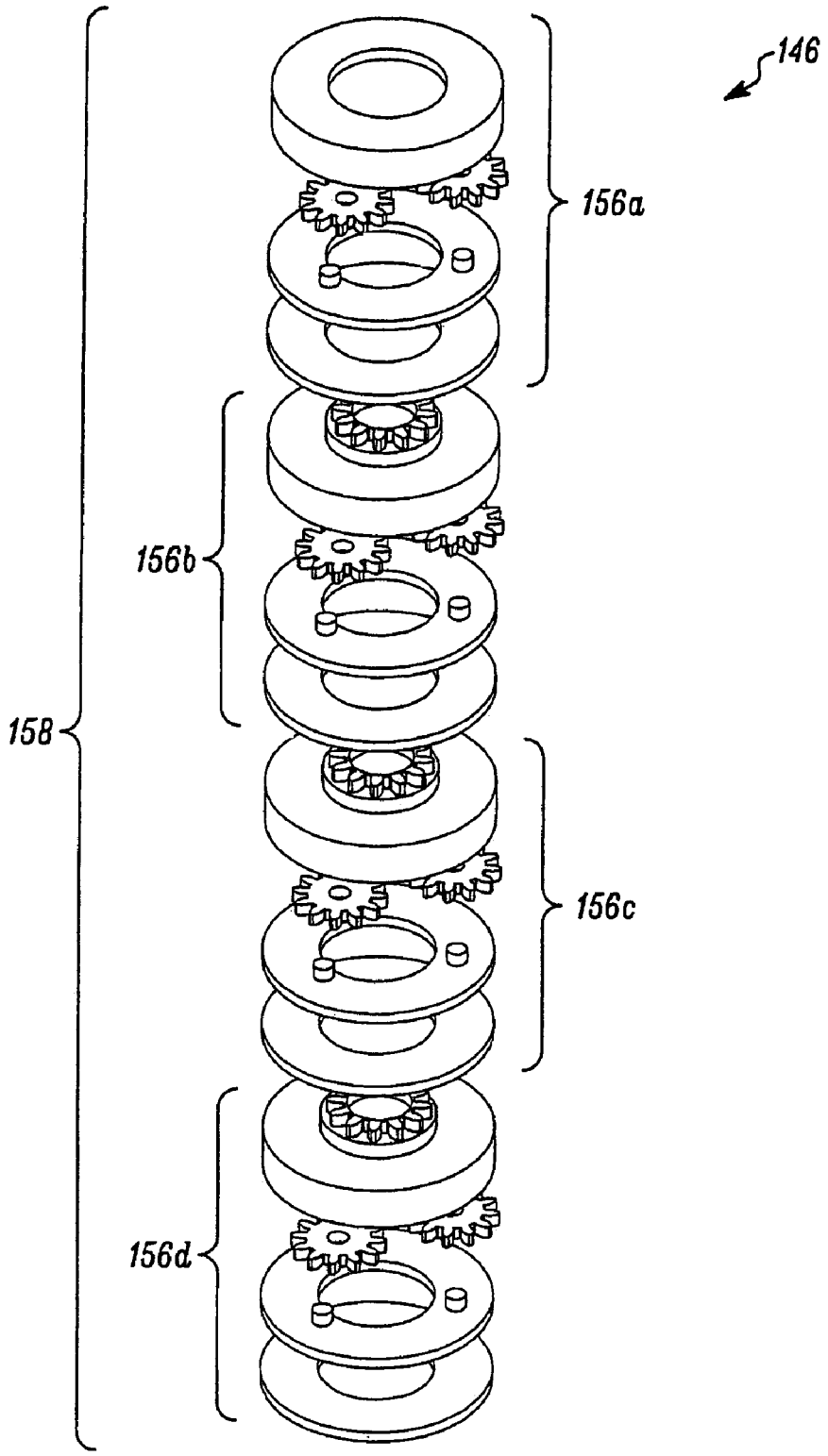
FIG. 7 is an exploded view of a universal flywheel assembly within the housing portion, in accordance with one embodiment of the present invention.

FIG. 7 illustrates an exploded view of the planetary gear assembly 146, in accordance with one embodiment of the present invention. The planetary gear assembly 146 includes a plurality of planetary gears, shown as 156*a*, 156*b*, 156*c*and 156*d*. In one embodiment, the planetary gears 156 provide for an overall stack height designated at 158. As recognized by one of skill in the art, variant numbers of planet gear assemblies 156 may be stacked upon each other to provide for a different stack height 158. Accordingly, the number of the planetary gear assemblies 156 may be readily adjusted to provide for fewer or more planetary gears 156 to achieve different stack heights 158. In the preferred embodiment, a stack height is defined by four planetary gears 156 within the planetary gear assembly 146.

When the power switch 108 is activated to an ON position, the motor 144 is activated by the power supplied from the power sources 112. The motor 144 rotates the gear 147, which in turn rotates the gears of the planetary gear assembly 146. The planetary gear assembly includes an engagement portion 160 (as illustrated in FIG. 6) which engages the engagement gear in order to rotate the blade assembly 128 disposed within the head portion 104.

Figure 8:
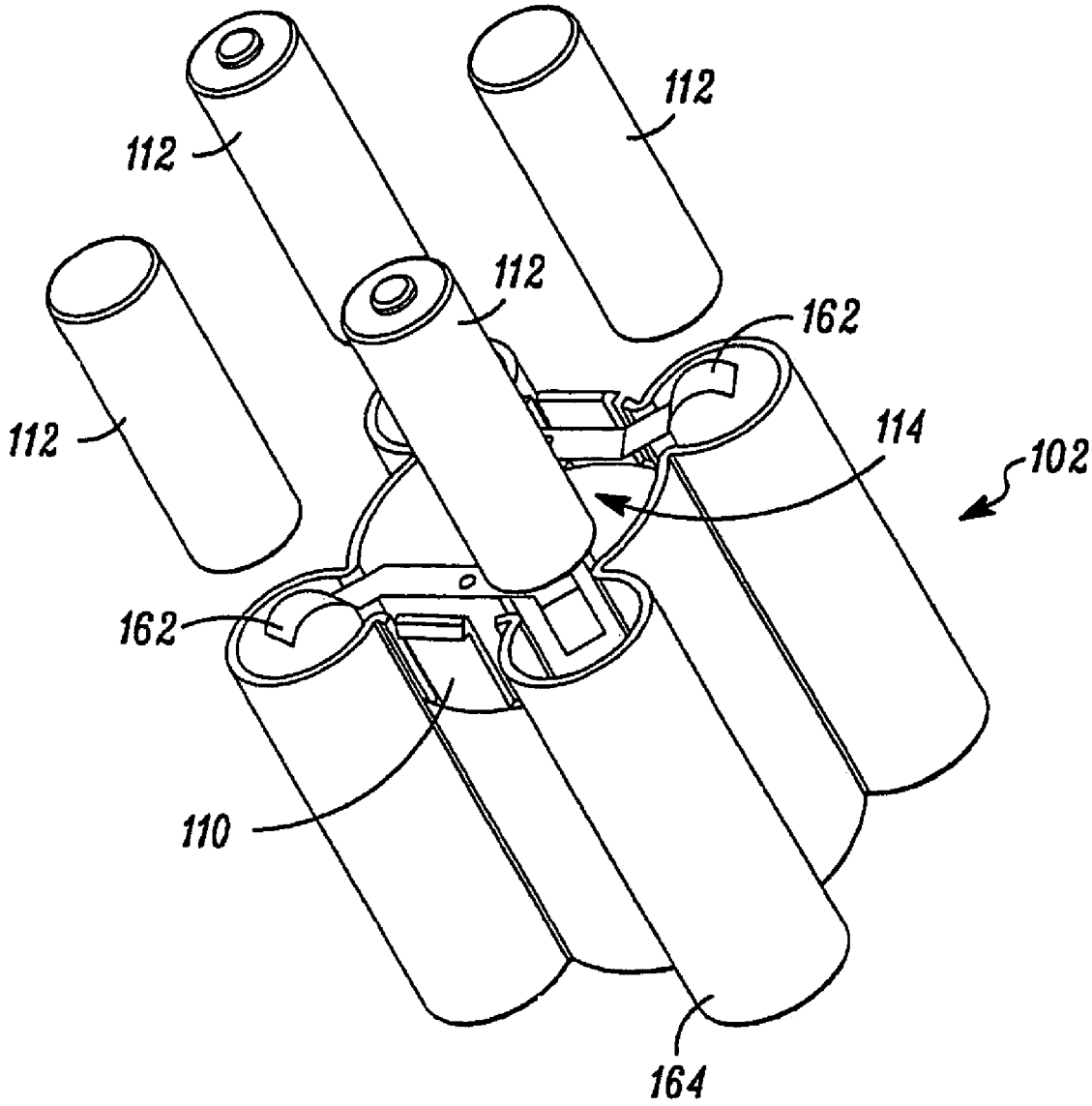
FIG. 8 is the exploded view of the base portion and a plurality of power sources, in accordance with one embodiment of the present invention.

FIG. 8 illustrates an exploded view of the base portion 102 including a plurality of power sources 112, such as batteries, disposed therein. A plurality of electrical contacts 162 are disposed on a bottom portion (not shown in FIG. 8) of the base portion 102. In one embodiment, the power sources 112 are aligned so that the electrical contacts 162 provide a current flow through multiple power sources 112, such that the electrical contacts 162 cooperatively power the motor disposed within the housing portion.

The power sources 112 are disposed within cylindrical receptacles 164 generally circumferentially disposed about the hollow aperture 114 of the base portion 102. In one embodiment, the bottom portion of the housing portion is disposed within the hollow receptacle 114, whereby the motor 144 is electrically coupled to the power sources 112. FIG. 8 further illustrates the connecting tab 110, which engages a bottom portion of the medial portion of the housing portion in order to connect the removable base portion 102 to the housing portion. The connecting tabs 110 may be displaced so that the housing portion 104 may be removed from the base portion 102 in order to replace spent power sources, such as dead batteries 112.

Figure 9:
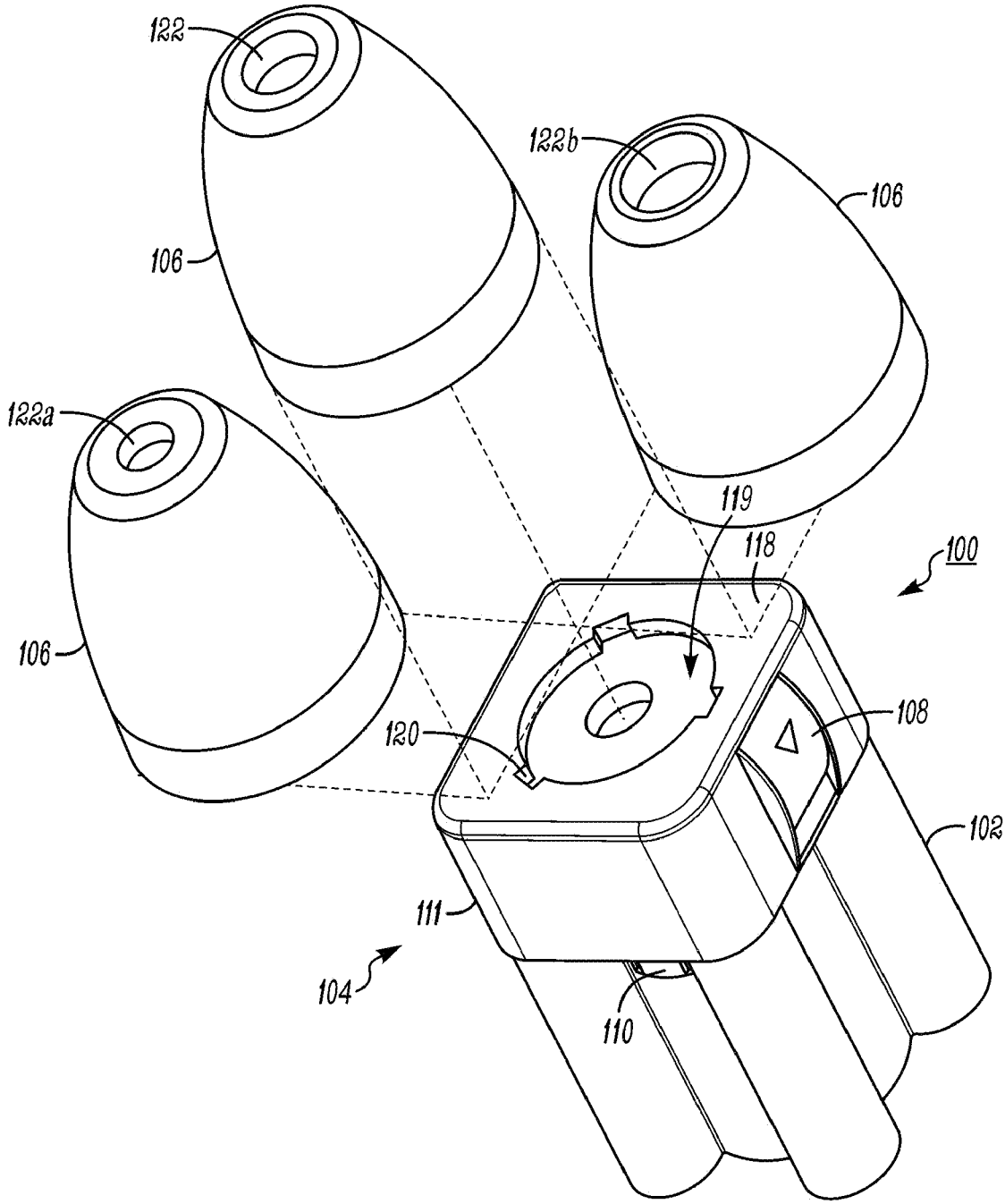
FIG. 9 is a perspective view of the electrical pencil sharpener of FIG. 1 shown illustratively with multiple interchangeable head portions.

In one embodiment of the present invention, a pencil sharpening system includes the base portion 102, the housing portion 104 connected to the base portion 102 and the motor 144 disposed within the housing portion 104 which is operatively coupled to a power source, such as the power sources 112. As shown on FIG. 9, the pencil sharpening system further includes multiple interchangeable head portions 106, where each head portion 106 includes a blade assembly 128 disposed within the head portion 106. The blade assembly 128 is operatively connected to the motor 144 via the engagement gear 138 and the selective activation, i.e. turning ON, of the motor 144 moves the blade assembly 128 relative to the head portion 106. Furthermore, each of the multiple head portions 106 further include at least one mounting element 126, which provides for a removable connection of the head portion 106 to the housing portion 104. In one embodiment, the pencil sharpening system, includes multiple interchangeable head portions having different aperture 114 and blade assembly 128 dimensions, which provide for the sharpening of pencils having different widths. Furthermore, within the pencil sharpening system, the multiple head portions 106 are interchangeable with the combination of base portion and housing portion, therein allowing a user to readily change head portions 106 and sharpen pencils having different dimensions.

It should be understood that there exists implementation of other variations and modifications of the invention in its various aspects, as may be readily apparent to those of ordinary skill in the art, and that the invention is not limited by the specific embodiments described herein. For example, the insertion receptacle 122 within the head portion 106 may be disposed on a side of the head portion, instead of being on the top portion of the head portion, thereby allowing a user to insert a pencil to be sharpened perpendicular to the alignment of the base portion 102 with the housing portion 104 and the head portion 106. In this alternative embodiment, the head portion 106 may include gear assemblies to transpose the rotational force generated by the motor 144 and the planetary gear assembly 148. It is therefore contemplated and covered by the present invention, any and all modifications, variations, or equivalent that fall within the sphere and scope of the basic underlying principals disclosed and claimed herein.

What is claimed is:

1. A multihead pencil sharpener, comprising:

a base portion including a hollow receptacle with a circular medial portion and a connecting tab having a plurality of cylindrical receptacles circumferentially disposed about the circular medial portion;

a plurality of power sources respectively inserted within each one of the plurality of cylindrical receptacles;

a housing portion having a bottom portion inserted in the hollow receptacle of the base portion, a medial portion engaged to the connecting tab of the base portion connected to the base portion, and a top plate with a recessed cavity and a plurality of receiving slots connected to the medial portion, wherein a power switch is medially disposed on the medial portion and wherein a motor is located in the bottom portion and a gear assembly located in the medial portion is mechanically coupled to the motor; and a series of head portions each having a lower portion and a top with an opening to define an insertion receptacle, a blade assembly with a blade at a cutting angle inserted within the insertion receptacle and a mounting flange with mounting elements, wherein the mounting flange engages the top plate of the housing portion and the mounting elements engage the receiving slots of the housing portion, said housing portion receiving only one head portion at a time;

wherein the different head portions of the series of head portions include openings of a different size and the cutting angle at a different angle.

2. The multihead pencil sharpener of claim 1, wherein the base portion includes four cylindrical receptacles and four power sources.

3. The multihead pencil sharpener of claim 2, wherein the power sources are batteries.

4. The multihead pencil sharpener of claim 2, wherein the four cylindrical receptacles are positioned regularly around the circular medial portion at 90 degree angle.

5. The multihead pencil sharpener of claim 2, wherein power switch is a ON/OFF switch with a sliding button between an ON position and an OFF position.

6. The multihead pencil sharpener of claim 2, wherein the gear assembly is a planetary gear assembly.

7. The multihead pencil sharpener of claim 2, wherein top plate is snap-fitted to the medial portion.

8. The multihead pencil sharpener of claim 1, wherein the head portions are interchangeable to sharpen pencils of different dimensions.

* * * * *